US010607494B2

(12) United States Patent
Durocher

(10) Patent No.: US 10,607,494 B2
(45) Date of Patent: Mar. 31, 2020

(54) AIRCRAFT APPROACH CHART

(71) Applicant: Andre Durocher, Gatineau (CA)

(72) Inventor: Andre Durocher, Gatineau (CA)

(73) Assignee: 3764729 Canada Inc., Gatineau (CA)

( * ) Notice: Subject to any disclaimer, the term of this patent is extended or adjusted under 35 U.S.C. 154(b) by 0 days.

(21) Appl. No.: 16/350,133

(22) Filed: Oct. 3, 2018

(65) Prior Publication Data

US 2019/0108761 A1 Apr. 11, 2019

Related U.S. Application Data

(60) Provisional application No. 62/606,689, filed on Oct. 5, 2017.

(51) Int. Cl.
*G08G 5/00* (2006.01)
*G08G 5/02* (2006.01)

(52) U.S. Cl.
CPC ..... *G08G 5/0047* (2013.01); *G08G 5/0021* (2013.01); *G08G 5/025* (2013.01)

(58) Field of Classification Search
None
See application file for complete search history.

(56) References Cited

U.S. PATENT DOCUMENTS 3,784,969 A * 1/1974 Wilckens ..... G01S 1/02 340/972
4,057,782 A * 11/1977 Muller ..... G01C 23/005 340/972
4,368,517 A * 1/1983 Lovering ..... G01C 23/005 340/972
5,111,400 A * 5/1992 Yoder ..... G01S 7/22 342/29
6,597,294 B1 * 7/2003 Ariens ..... G08G 5/0021 340/945
7,084,785 B2 * 8/2006 Rouquette ..... B64D 45/04 340/972
7,109,889 B2 * 9/2006 He ..... G01C 23/005 340/971
7,216,069 B2 * 5/2007 Hett ..... G01C 23/005 340/972
7,522,977 B2 * 4/2009 Foucart ..... G01C 23/005 340/972
7,693,621 B1 * 4/2010 Chamas ..... G08G 5/0021 340/951
8,370,005 B2 * 2/2013 Wilson ..... G01C 23/005 244/183

(Continued)

*Primary Examiner* — Chico A Foxx
(74) *Attorney, Agent, or Firm* — Cassan Maclean IP Agency Inc.

(57) ABSTRACT

An instrument flight rules (IFR) approach chart for facilitating a pilot's approach and landing of an aircraft at an airport includes a straight vertical line representing a runway on which the aircraft is to land with the beginning of the runway closer to the bottom than the top of the map, a second straight line representing a final approach flight path vertically aligned with the runway line and extending downwardly from the bottom end of the runway line, third straight lines extending across and perpendicular to the second straight line, altitude numbers at the ends of the third lines on one side of the second line and distance to the runway number at the ends of the third line on a second side of the second line.

7 Claims, 2 Drawing Sheets

(56) References Cited

U.S. PATENT DOCUMENTS 8,581,748 B1 * 11/2013 Barber ..... G01C 23/005 340/971
8,589,071 B2 * 11/2013 Feyereisen ..... G08G 5/025 340/972
8,825,238 B2 * 9/2014 Peptione ..... G05D 1/0676 340/963
8,917,191 B1 * 12/2014 Tiana ..... G01C 23/00 340/945
9,092,975 B2 * 7/2015 Pepitone ..... G08G 5/0021
9,139,307 B2 * 9/2015 Sridhar ..... B64D 43/00
9,242,727 B1 * 1/2016 Alvarez ..... B64C 27/006
9,245,450 B1 * 1/2016 Chiew ..... G05D 1/0676
9,424,756 B2 * 8/2016 Gaertner ..... G08G 5/0021
9,443,433 B1 * 9/2016 Conway ..... G08G 5/0013
2007/0112517 A1 * 5/2007 Goldstein ..... G01C 23/00 701/301
2007/0260364 A1 * 11/2007 Dwyer ..... G01C 23/00 701/3
2008/0103641 A1 * 5/2008 Ratcliffe ..... G01C 23/005 701/3
2009/0051570 A1 * 2/2009 Clark ..... G08G 5/0021 340/971
2009/0093953 A1 * 4/2009 Wiesemann ..... G01C 23/005 701/532
2010/0026525 A1 * 2/2010 Feyereisen ..... G01C 5/005 340/972
2010/0127895 A1 * 5/2010 Wilson ..... G01C 23/00 340/972
2010/0148990 A1 * 6/2010 Burgin ..... G08G 5/0021 340/971
2010/0262318 A1 * 10/2010 Ariens ..... G01C 21/00 701/3
2010/0305786 A1 * 12/2010 Boorman ..... G08G 5/0021 701/16
2011/0025530 A1 * 2/2011 He ..... G01C 23/005 340/972
2012/0035849 A1 * 2/2012 Clark ..... G01C 23/00 701/467
2012/0265376 A1 * 10/2012 Fleiger-Holmes ..... G01S 1/18 701/16
2013/0041529 A1 * 2/2013 He ..... G08G 5/0021 701/17
2013/0090841 A1 * 4/2013 Barraci ..... G08G 5/0013 701/120
2013/0278444 A1 * 10/2013 Venkataswamy .... G08G 5/0013 340/972
2013/0304284 A1 * 11/2013 Kadavil ..... G01C 23/00 701/16
2014/0015695 A1 * 1/2014 Samuthirapandian ..... G08G 5/0021 340/972
2014/0074324 A1 * 3/2014 Burgin ..... G08G 5/02 701/9
2014/0097972 A1 * 4/2014 Barraci ..... G01C 23/005 340/971
2014/0354456 A1 * 12/2014 Gannon ..... G08G 5/007 340/972
2015/0002316 A1 * 1/2015 Sridhar ..... B64D 43/00 340/953
2015/0032298 A1 * 1/2015 Pepitone ..... B64D 43/00 701/4
2015/0364044 A1 * 12/2015 Kashi ..... G08G 5/0095 701/120
2017/0116866 A1 * 4/2017 Jeong ..... G08G 5/025
2017/0214904 A1 * 7/2017 Wyatt ..... H04N 13/302
2017/0287342 A1 * 10/2017 Hodge ..... G01C 23/005
2019/0096270 A1 * 3/2019 Wang ..... G08G 5/025

* cited by examiner

AIRCRAFT APPROACH CHART

FIELD OF THE INVENTION

This invention relates to an instrument flight rules (IFR) approach chart for facilitating a pilot's approach and landing of an aircraft at an airport.

BACKGROUND OF THE INVENTION

The approach and landing of an aircraft requires a pilot's full attention, particularly under unfavorable weather conditions. When the ground is not visible because of cloud cover, a pilot is required to make an instrument landing. Moreover, all airlines make IFR approaches most of the time. For such purpose, IFR approach charts are provided for most runways and airports around the world. The charts are available as hard copies or can be accessed from the aircraft navigation equipment or from an electronic tablet.

Existing charts are complicated to read and understand. They need to be studied and understood before the approach. They need to be practiced. The problems with existing charts are as follows:

(1) Existing charts require a pilot to use two views, namely a plan view or a view from the sky and a profile view or a view from the side. The pilot needs to move his or her eyes from the plan view to the profile view, find needed information from both views and with this information draw a mental image of the approach to fly;

(2) Existing charts require the pilot to ask a lot of questions. The pilot needs to calculate mentally, precisely and in a very short time very important information such as, if the ground speed (GS) is 100 knots, how many feet per minute are required to descend from 2240 feet to 1650 feet in 4.3 miles while flying the aircraft and talking to air traffic control;

(3) Existing charts are always drawn north up, i.e., with north at the top of the page, which makes it difficult to provide a good picture of what the pilot will see on the approach;

(4) Information is written in many places, making it hard to find when time can be a question of life or death;

(5) The same information is written more than once and sometimes four times. The charts thus loaded with information, requiring a lot of time to read which the pilot does not have; and (6) Because it takes time to read and understand the plates, a pilot spends less time looking at the instruments which sometimes results in a loss of control of the aircraft and a crash.

An object of the present invention is to provide solutions to the above-mentioned problems in the form of a relatively simple chart, which is more user friendly than existing charts, and which enables a pilot to make a precise, easy and safe approach to a runway.

SUMMARY OF THE INVENTION

According to one aspect, the invention relates to a final approach chart on which the final flight path is aligned with the runway, and both the flight path and runway are oriented in a straight line extending from the bottom towards the top of the plate. More specifically, the invention provides an approach chart for facilitating a pilot's approach and landing of an aircraft at an airport comprising a planar map or chart having a first straight line extending vertically on the map or chart representing a runway on which the pilot is to land the aircraft with the beginning of the runway closer to the bottom than the top of the map or chart; a second straight line representing a final approach path vertically aligned with the first straight line and extending downwardly on the map or chart from the bottom of the first line; a plurality of spaced apart third lines perpendicular to and extending across said second lines; altitude numbers at the ends of the third lines on the left side of the second line; and distance to the runway numbers at the ends of the third lines on the right side of said second line.

BRIEF DESCRIPTION OF THE DRAWINGS

The invention is described below in greater detail with reference to the accompanying drawings, which illustrate a preferred embodiment of the invention, and wherein.

DETAILED DESCRIPTION OF THE INVENTION

Figure 2:
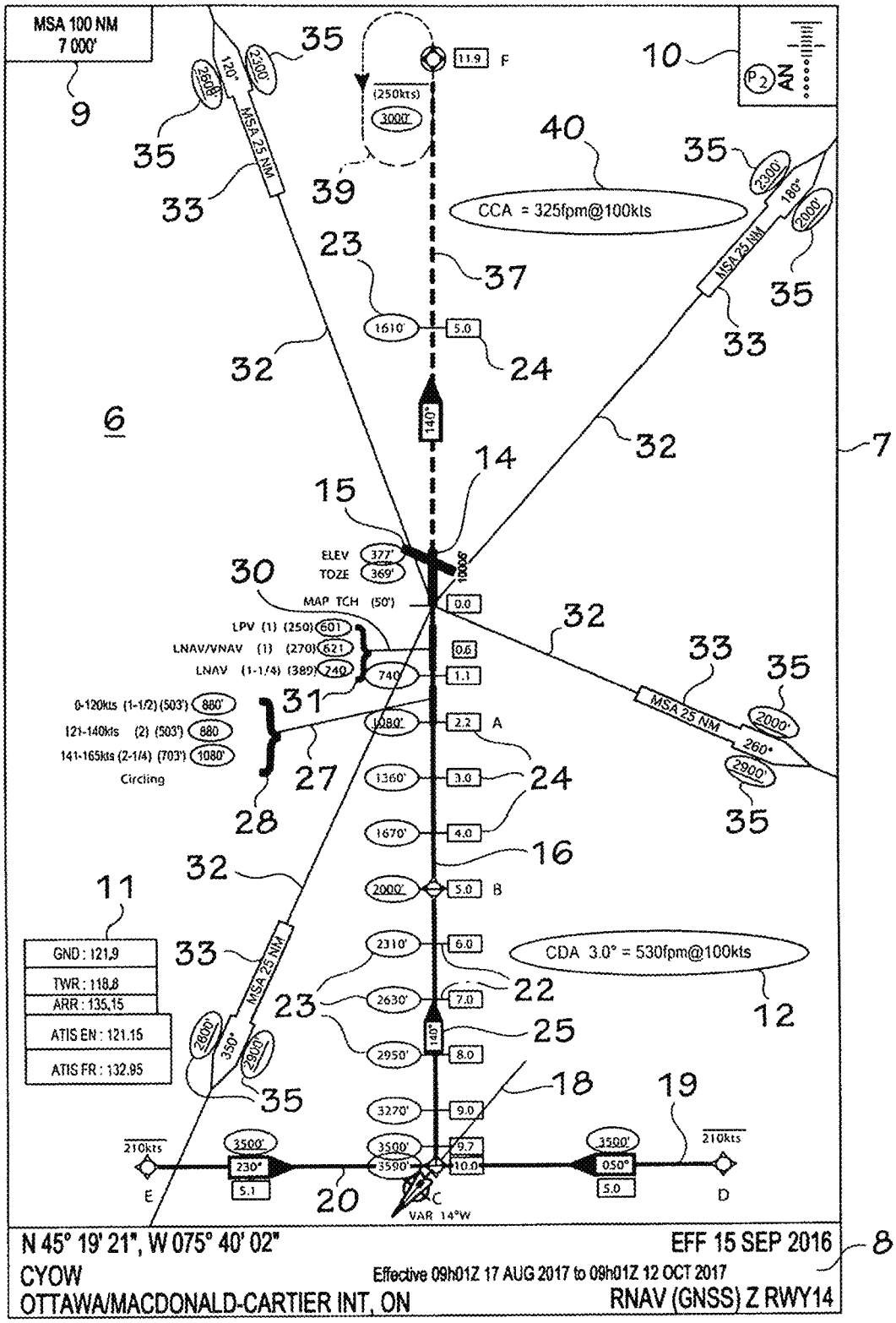
FIG. 2 is a schematic plan view of an approach chart for the same airport in accordance with the present invention.

As mentioned above and as shown in FIG. 1, existing charts include two views, namely a plan view 1 of an airport and the surrounding area, and a profile view 2 from the side of a flight path 3 on final approach to a runway 4. The plan view 1 shows north at the top of the chart and south at the bottom of the chart. Thus, unless the runway 4 extends in a south to north direction, the flight path 3 and the runway 4 are inclined with respect to the vertical in the plan view 1:

With reference to FIG. 2, the chart of the present invention includes a chart or map 6 surrounded by a rectangular border 7. A large box 8 at the bottom of the border 7 contains information including the name of the airport, the International Civil Aviation Organization Identifier and coordinates of the airport, the type of approach (RNAV or a GPS approach is a type of instrument approach and GNSS stands for Global Navigation Satellite Systems including GPS), and the effective dates of the chart. Smaller boxes 9 and 10 at the top of the plate contain information with respect to the minimum safe altitude in a 100 nautical miles radius of the airport and the type of lights found at the runway. A table 11 on the left side of the chart lists communication frequencies and their acronyms in the order they are needed from bottom to top. Automatic Terminal Information Service (ATIS) is colored pink, the ground frequency is brown, the tower frequency is green and air frequencies are blue. Frequency boxes in the table 11 have different lengths making them easier to spot. An elongated oval 12 on the right side of the chart above box 8 contains the constant descent angle (CDA) for the approach, and the rate of descent (530 feet per minute) at a ground speed of 100 knots. If needed, notes are also provided on the right side of the chart above the box 8.

The runways 14 and 15 of the airport are indicated by first thick lines which in the case of the airport shown in FIG. 2 intersect each other. In accordance with the chart shown in FIG. 2, runway 14 is to be used to land an aircraft (not shown). The runway 14 is drawn track up, i.e. the runway extends vertically on the plate. A final approach flight path 16 is drawn as a thinner second line aligned with and abutting the bottom approach or leading end of the runway 14: Thus, the final approach path 16 and the runway 14 are in front of the pilot which makes it easier to make flight decisions. The bottom end of the final approach path 16 is located at a waypoint C. A north-south arrow 18 extends through waypoint C. Other waypoints A and B are provided on the final approach flight path 16, and waypoints D and E are provided on flight paths 19 and 20 at 90 degrees to the final approach flight path 16. Waypoints D and E for directing a pilot to the final approach path 16 are located at 50 nautical miles from waypoint C on either side of the final approach path 14.

A plurality of spaced apart short lines 22 extend perpendicularly across the final approach flight path 16. Altitude numbers are provided in ovals 23 at the left ends of the lines 22, and distance numbers to the leading (bottom) end of the runway 14 are provided in rectangular boxes 24 at the right ends of the lines 22. These numbers tell the pilot the altitude that the aircraft should be at when the aircraft is at an indicated distance to the runway 14.

A box 25 in the final approach path 16, a short distance from the waypoint C contains an indication of the direction of the final approach path 16. A diagonal line 27 extends outwardly from the altitude side of the final approach path 16 a distance before the leading end of the runway 14. A half bracket 28 at the outer end of the line 27 borders the rear ends of numbers in which indicate minimum altitudes for various ground speeds with minimum visibilities and height above the ground (503 feet) for circling approaches. A second line 30 extends outwardly from the altitude side of the final approach flight path 16 a short distance from the leading end of the runway 14. A half bracket 31 at the outer end of the line 27 borders one side of the acronyms LPV, LNAVNNAV and LNAV and a row of numbers after the acronyms. The acronyms and numbers represent the minimum safe altitudes and visibilities for an approach under localizer performance with vertical guidance (LPV), a lateral navigation vertical navigation (LNAVNNAV) approach or only lateral navigation (LNAV) approach.

Diagonal lines 32 with generally spear-shaped boxes 33 near the outer ends to clear obstacles thereof extend outwardly at various angles from the leading end of the runway 14. The boxes 33 contain details of minimum safe altitudes (MSA) up to twenty-five nautical miles (NM) from the airport in various directions. Ovals 35 on the sides of the boxes 33 provide minimum safe altitudes a up to 25 nautical miles (NM) from the runway 14.

A broken line 37 extends vertically upwardly from the trailing end of the runway 14 indicating a missed leg. As in the case of the final approach 16, numbers in ovals 23 and boxes 24 indicate altitudes to be reached at distances from the runway on the missed leg and at a missed waypoint F. A larger oval 39 indicates a holding pattern. An oval 40 to the right side of the missed leg 37 contains the constant climb angle (CCA) in rate of climb in feet per minute at a ground speed of 100 knots in the missed leg.

Solutions to the above six problems are listed in the following description.

Figure 1:
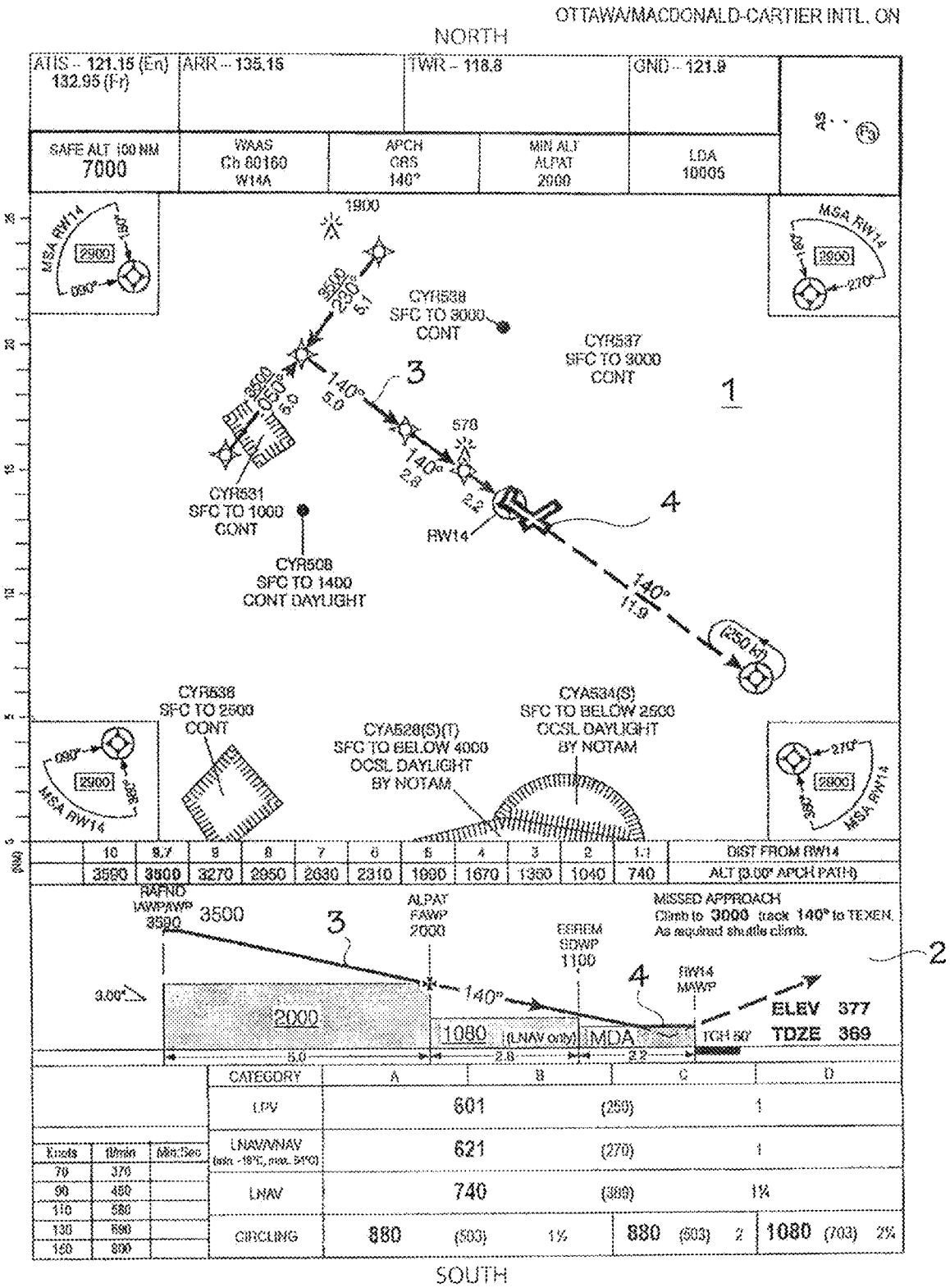
FIG. 1 (Prior art)
FIG. 1 is a schematic drawing of an approach chart for the Ottawa/MacDonald-Cartier International Airport in Ottawa, Canada.

(1) There is no profile view on the chart of the present invention. All information is found in one view only. As shown in FIG. 1, existing charts include separate profile views 2 showing a few altitudes and distances. The pilot is required to shift his or her eyes from the flight path 3 of the chart to the profile 2 to find information on the profile view, incorporate this information with the information in the plan view and do mental calculations such as calculate the rate of descent required to drop down to the next required altitude.

(2) The chart of the present invention provides answers to a pilot's questions. For example, if the flight path angle (FPA) is 3 degrees and the GS is 100 kts, the rate of descent is 530 fpm. The FPA and the rate of descent for 100 kts will be noted on the right side of the final leg. If the ground speed is 90 kts (10% less than 100 kts), the rate of descent will be 530 fpm−10% (53 fpm) which equals 480 fpm. At 115 kts ground speed, the rate of descent will be 530 fpm+15% (80 fpm)=610 fpm. If the FPA is 4 degrees, the rate of descent will be ⅓ higher or 700 fpm at 100 kts. If the FPA is 3 degrees, the altitude change for every nautical mile is 320 feet, which is readily seen on the left side of the final approach leg, e.g., 2950'−2630'=320' for every mile.

(3) The chart is drawn track up. As shown in FIG. 1, on existing approach plates north up, i.e. the top of the plate is north and the bottom of the chart is south. Thus, unless the runway 4 extends in a south/north direction and the aircraft is going to land northbound, the final approach path and the runway alignment can be at a considerable angle from the top (north) of the chart. As shown in FIG. 2, in the case of the present invention, the chart is track up, i.e., the final approach 16 and the runway 14 are in front of the pilot which makes it easier to figure things out.

(4) Information is written and found where it belongs, in the order needed and is color coded.

On the chart of present invention, the location name of the airport, International Civil Aviation Organization identifier and coordinates), the type of approach and effective dates are found in the box 8 at the bottom of the plate. If needed, notes are listed on the right side of the plate from bottom to top in order of importance (more important to less important).

Communication (COMM) frequencies and their names are noted in the order they are needed from bottom to top on a table 11 on the left side of the plate. Automatic Terminal Information Service (ATIS) is colored pink, the ground frequency is brown, the tower frequency is green and air frequencies are blue. Frequency boxes in the table 11 have different lengths making them easier to spot.

Traditional navigation frequencies, types, identifiers, morse codes and names are noted 1, 2, 3, 4, etc above the COMM frequencies reading from bottom to top in the order they should be tuned.

Altitudes and distances from the runway 14 are clearly marked beside the final approach leg 16. Altitudes are found in ovals 23 on the left side of the approach and missed leg 37.

If there is a certified means of measuring the distances to the runway 14 [GPS, distance measuring equipment (DME) or VORTAC (a co-located VHF omnidirectional range (VOR) beacon and a tactical air navigation system (TACAN) beacon)], the distances are shown in rectangular boxes 24 to the right of the approach leg 16. The distances shown in the boxes 24 are from the distance measuring equipment or a GPS distance. With a reading of 4.0 miles on the distance measuring equipment, the position of the aircraft is where the number 4.0 appears on the chart. If there is no certified means for measuring the distances, for situational awareness, a non-certified GPS can be used to obtain a distance to the center of the airport. Such distances are shown on the plate with no boxes around them.

As on existing charts, minimum crossing altitudes are underlined, maximum crossing altitudes are overlined and compulsory altitudes are underlined and overlined. The height above the ground (AGL) is noted in parenthesis to the left of the corresponding altitude, e.g. (503').

Circling altitudes are shown in blue. The circling altitudes are noted as close as possible to corresponding altitude on the final leg. The minimum descent altitude (MDA) and the decision altitude (DA), where you expect to see the ground are shown in green. The letters ELEV (elevation of the airport) and TDZE (touch down zone elevation) are brown and are located on the left of the runway. The length of the runway 14 is provided in brown numbers; which are printed parallel to the runway, i.e. from bottom to top.

(5) Information is written only one time. This makes the chart less loaded with information and it takes less time to read.

(6) Because it takes less time to read and understand the chart, the pilot can spend more time looking at his/her instruments and there is less chance of losing control of the aircraft and crashing.

A chart can be an overlay on a VNC [VFR (visual flight rules) navigation chart] or LE (Low Enroute navigation chart) or a Google Earth map. With the chart of the present invention, the pilot immediately knows the minimum safe altitude. Like the LE and standard terminal arrival (STAR), the chart described herein provides all of the information required for a precise and safe approach. When flying instrument flight rules (IFR) or visual flight rules (VFR), the aircraft position and the minimum safe altitude are the most important information.

The invention claimed is:

1. An approach chart for facilitating a pilot's approach and landing of an aircraft at an airport comprising a planar map or chart having a first straight line extending vertically on the map or chart representing a runway on which the pilot is to land the aircraft with the beginning of the runway closer to the bottom than the top of the map or chart; a second, unbroken straight line representing a final approach path vertically aligned with the first straight line and extending downwardly on the map or chart from the bottom end of the first line, the second straight line defining a continuation of the first straight line; a plurality of short, spaced apart third lines perpendicular to and extending across said second lines; altitude numbers at the ends of the third lines on one side of and in close proximity to the second line; and distance to the runway numbers at the ends of the third lines on a second side of and in close proximity to said second line.

2. The approach chart of claim 1, including a final approach waypoint icon at the bottom end of the second line.

3. The approach chart of claim 1, including ovals around said altitude numbers, and rectangular boxes around said distance to the runway numbers.

4. The approach chart of claim 1, including a broken vertical line aligned with and extending upwardly from the top end of the first line indicating a flight path of a missed landing of the aircraft.

5. The approach chart of claim 1, wherein said first line is thicker than said second and third lines.

6. The approach chart of claim 5, wherein a minimum descent altitude and a decision altitude at which the pilot expects to see the ground are colored green.

7. The approach chart of claim 1, including the acronyms ELEV and DZE followed by elevation numbers on one side of the first line indicating the elevation of the airport above sea level and touch down zone elevation, respectively.

* * * * *